United States Patent [19]

Luedtke et al.

[11] 3,982,648

[45] Sept. 28, 1976

[54] LIFT ARM SAFETY BAR

[75] Inventors: Ronald E. Luedtke, Elmhurst; Clarence A. Ardelt, Wheaton, both of Ill.

[73] Assignee: International Harvester Company, Chicago, Ill.

[22] Filed: Nov. 10, 1975

[21] Appl. No.: 630,106

[52] U.S. Cl. ..... 214/776; 92/23; 214/140

[51] Int. Cl.[2] ..... E02F 3/80

[58] Field of Search ..... 214/131 R, 140, 773, 214/774, 775, 776; 92/15, 23; 212/8 R, 39 R, 39 B; 298/17 B; 187/8.47, 8.49; 172/466, 481

[56] References Cited

UNITED STATES PATENTS

| | | | |
|---|---|---|---|
| 3,088,546 | 5/1963 | Ross et al. | 187/8.49 |
| 3,135,555 | 6/1964 | Caskey | 92/23 X |
| 3,272,558 | 1/1966 | Rathman et al. | 298/17 B X |
| 3,360,146 | 12/1967 | Borer et al. | 214/776 |
| 3,396,863 | 8/1968 | Borer et al. | 214/776 |
| 3,502,228 | 3/1970 | Tamborino | 212/39 R |
| 3,918,601 | 11/1975 | Zimmerman | 214/776 |

*Primary Examiner*—L. J. Paperner
*Attorney, Agent, or Firm*—John W. Gaines; Floyd B. Harman

[57] ABSTRACT

Safety bar for maintaining a piston rod in an extended position with respect to its cylinder. The rod-and-cylinder function as the hydraulic actuator for the lift arm in a front-end crawler-loader, and are connected at the rod end to the loader lift arm and at the cylinder end to a loader carrier frame in the crawler-loader. The safety bar has an operative position where it is retained, under compression, adjacent the piston rod to prop the raised rod and lift arm against retrograde collapse, and the bar is swingably mounted to the lift arm for elevation into an inoperative position adjacent the lift arm.

8 Claims, 5 Drawing Figures

LIFT ARM SAFETY BAR

Our invention relates to a safety bar adapted to maintain a piston rod in an extended position with respect to its cylinder. More particularly, in the specific application of the invention contemplated, the rod-and-cylinder function as the hydraulic actuator for the lift arm in a front-end crawler-loader, and are connected at the rod end to the loader lift arm and at the cylinder end to a loader carrier frame in the crawler-loader. The safety bar has an operative position where it is retained, under compression, adjacent the piston rod to prop the raised rod and lift arm against retrograde collapse, and the bar is swingably mounted to the lift arm for elevation into an inoperative position adjacent the lift arm.

To avoid some less-than-obvious pitfalls we have noted with safety bar installations, the designing in accordance with our safety bar invention should be with the objectives of: keeping the cylinder structure disassociated therefrom and unencumbered thereby at both ends of the cylinder structure whenever the bar is stored in inoperative position; also keeping the cylinder structure, when the safety bar is in the operative position, so positioned thereadjacent as to assure that no bending load will be imposed at the rod guide and seal of the cylinder structure; additionally, directing the stance of the safety bar in its operative position so that it angles itself into such position all the more tightly against dislodgement as the loading increases, and all without a retainer or fastener between the bar and cylinder structure; further, assuring that the cylinder structure will be automatically latched, extended, as soon as the cylinder structure reaches extended position whenever the safety bar has been previously released from inoperative position; and additionally, in the unlikely emergency situation wherein the cylinder structure and safety bar fight one another, ensuring that the cylinder structure if hydraulically subjected to a power-down operation, will merely force the safety bar so as to be trapped in a tighter position against dislodgement.

Our invention, with the utilization of a particular geometry insuring endwise positioning with automatic alignment of the bar, avoids the noted pitfalls as will now be explained in detail. Features, objects, and advantages will either be specifically pointed out or become apparent when, for a better understanding of the invention, reference is made to the following description taken in conjunction with the accompanying drawings, which show a preferred embodiment thereof and in which.

Figure 1:
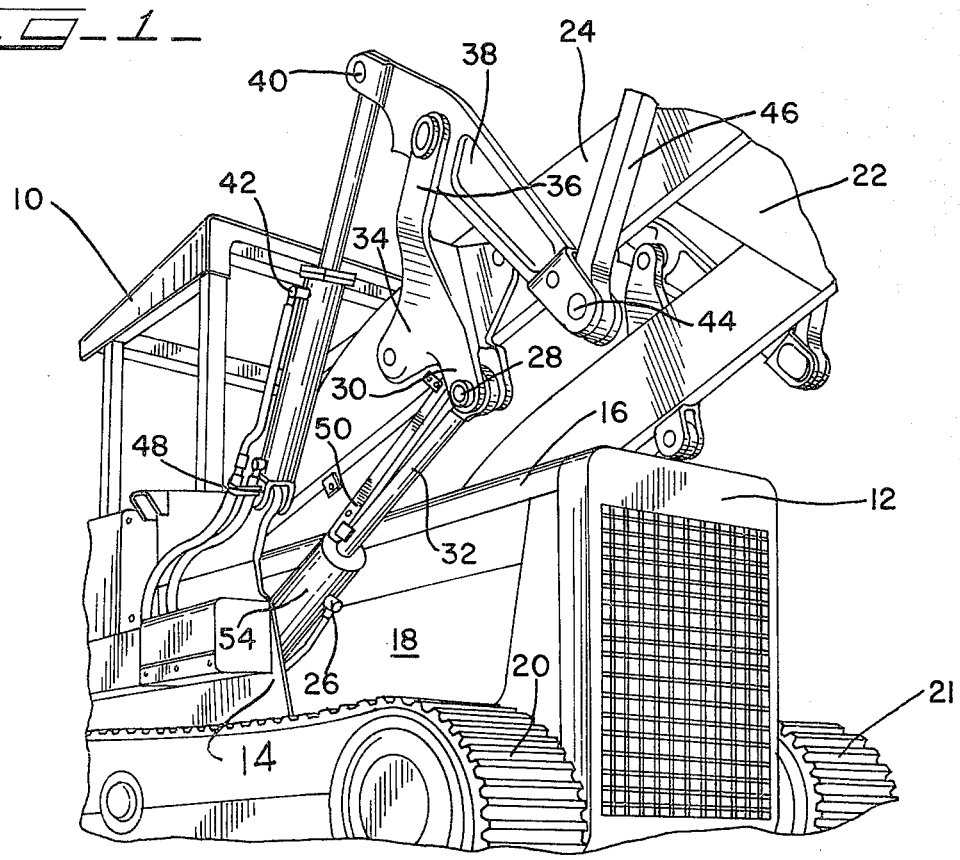
FIG. 1 is a right side elevational view of the upper front portion of a front-end crawler-loader in perspective, showing the associated loader boom arm structure and embodying the present safety bar invention.
Figure 4:
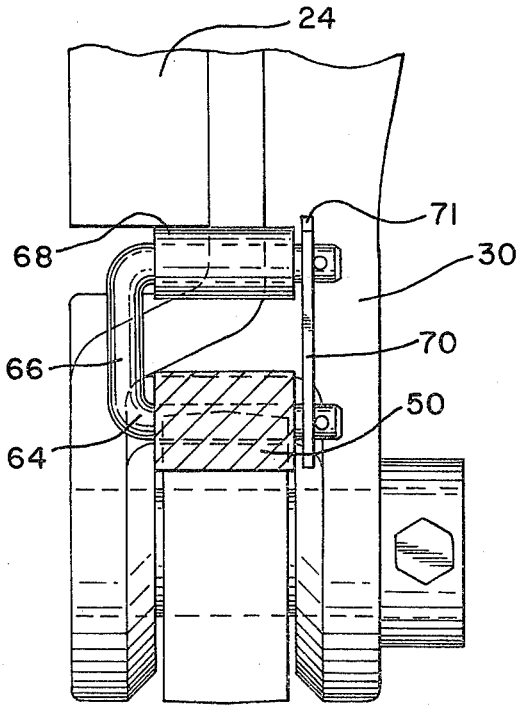
FIG. 4 is an elevational cross section taken along the line IV — IV of FIG. 2, showing the hanger link connection at the restrained end of the safety bar.

More particularly, in FIG. 1, a front-end crawler-loader 10 is shown having at the front portion a radiator and guard structure 12, and at an amidships portion a generally upright, loader carrier frame 14. An engine compartment hood 16 bridges between the structure 12 and frame 14 so as to define the top of an engine compartment containing a tractor engine 18.

A pair of endless tracks include assemblies disposed with a right track assembly 20 on the near side of the tractor and a similar track assembly 21 on the other side of the crawler-loader 10.

A generally longitudinally disposed, loader boom arm structure 22 includes a pair of arms disposed with a right lift arm 24 on the near side of the tractor as viewed in FIG. 1 and a similar lift arm on the opposite side. Because of the duplication, only the portion of the essentially symmetrical loader boom arm structure 22 on the near side will be described.

The right lift arm 24 and a right lift cylinder 26 therefor project forwardly from the carrier frame 14 and are secured together at their projecting end by a pivotal connection 28 therebetween, at a point on the right lift arm 24 offset downwardly by an arm crook 30 thereon and at a point on the eye end of the piston rod 32 of the cylinder. The arm crook 30 forms part of a cast multi-arm structure 34 rigidly secured to the right lift arm 24.

The structure 34 further includes a rigid understanding arm 36 supporting the central section of a bucket bell crank 38 for rocking movement from a generally horizontal position about a transverse pivot axis. At the rear end, the bell crank 38 has a pivot connection 40 to the upstanding rod end of a bucket tilt cylinder 42 and, at the front end, the bell crank 38 has a pivot connection 44 to the tilt link 46 connected to a loader bucket, not shown, pivotally mounted at the forward end of the loader boom arm structure 22. The tilt cylinder 42, having a pivotal connection 48 at the cylinder end to the front of the carrier frame 14 at the top, reacts forces into the latter as the cylinder extensively and retractively moves for hydraulically swinging the intervening bell crank 38 to control the bucket tilt angle during various phases of a loading and unloading operation.

Likewise mounted to the loader carrier frame 14, the right lift arm 24 and the right lift cylinder 26 are swingably connected to the frame 14 in an upper portion and in a lower portion, respectively, to swing up and down substantially parallel to one another in a longitudinal vertical plane. The loader boom arm structure 22 is transversely rigid so as to keep the loader bucket, not shown, on a stable horizontal axis, and the right arm 24 and cylinder 26 at the near side move in unison with the left arm, cylinder, and associated structure on the left side of the crawler-loader 10. Prop means is provided to prop up the boom arm structure 22 for reasons now to be explained.

In use installed at one or both sides of the structure 22 when the referred to lift cylinders are extended, a rigid elongaged safety bar 50 of steel between the boom lift arm 24 and lift cylinder 26 holds the piston rod 32 in an extended position relative to its cylinder 54. Propping a lift arm or arms in this way enables the boom structure 22 to be safely left in an elevated position to provide access for the maximum number of maintenance servicing operations to be performed on the crawler-loader. Locking the extended cylinder in this manner means no reliance must be made upon the fluid therein, and also retraction is prevented, in case of accidental lowering of the lift arm because of faulty operation of the hydraulic system.

BAR STRUCTURE — FIGS. 2, 3, 4, 5

The generally horizontally-disposed safety bar 50 has a free end projecting rearwardly and formed with a bolt aperture 56 extending horizontally on the major central axis of its generally rectangular cross section. Intermediate the bolt aperture 56 and the latching abutment base 58 at the extremity thereof, the bar 50 carries a parallel pair of spaced apart depending, centering tabs 60 for stabilizing the free end of the bar upon, and in the vertical plane of, the lift cylinder rod 32.

The bar 50 at its restrained forward end adjacent its ram abutment base 62 at the extremity has a shackle opening pivotally receiving the lower leg 64 of a C-shaped shackle 66 diposed generally in a vertical plane. The upper leg of the shackle 66 pivotally fits in a bearing sleeve 68 which is secured by welding to the undersurface of the lift arm 24 in the vertical plane of the cylinder rod 32. An apertured link plate 70 at a point opposite to the main body of the shackle 66 is fitted over the protruding ends of the upper pivot leg and the lower pivot leg 64 of the shackle so as to form therewith a depending hanger link 71 and is secured in place by the respective upper and lower cotter pins 72 and 74 (FIG. 2) lodged in the ends of the legs.

Figure 5:
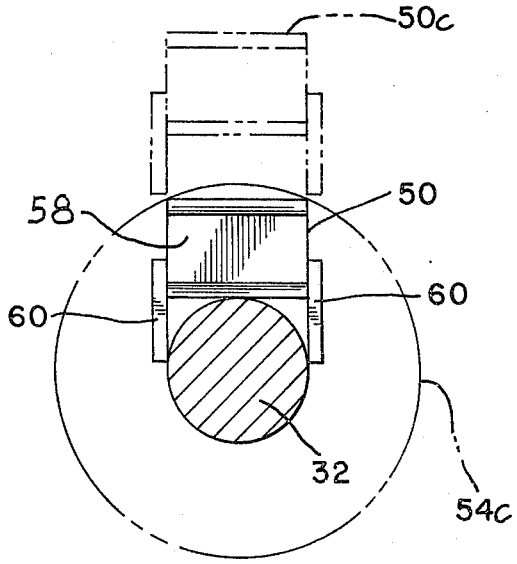
FIG. 5 is an elevational cross section taken along the line V — V in FIG. 2, showing the latched position of the free end of the safety bar.
Figure 2:
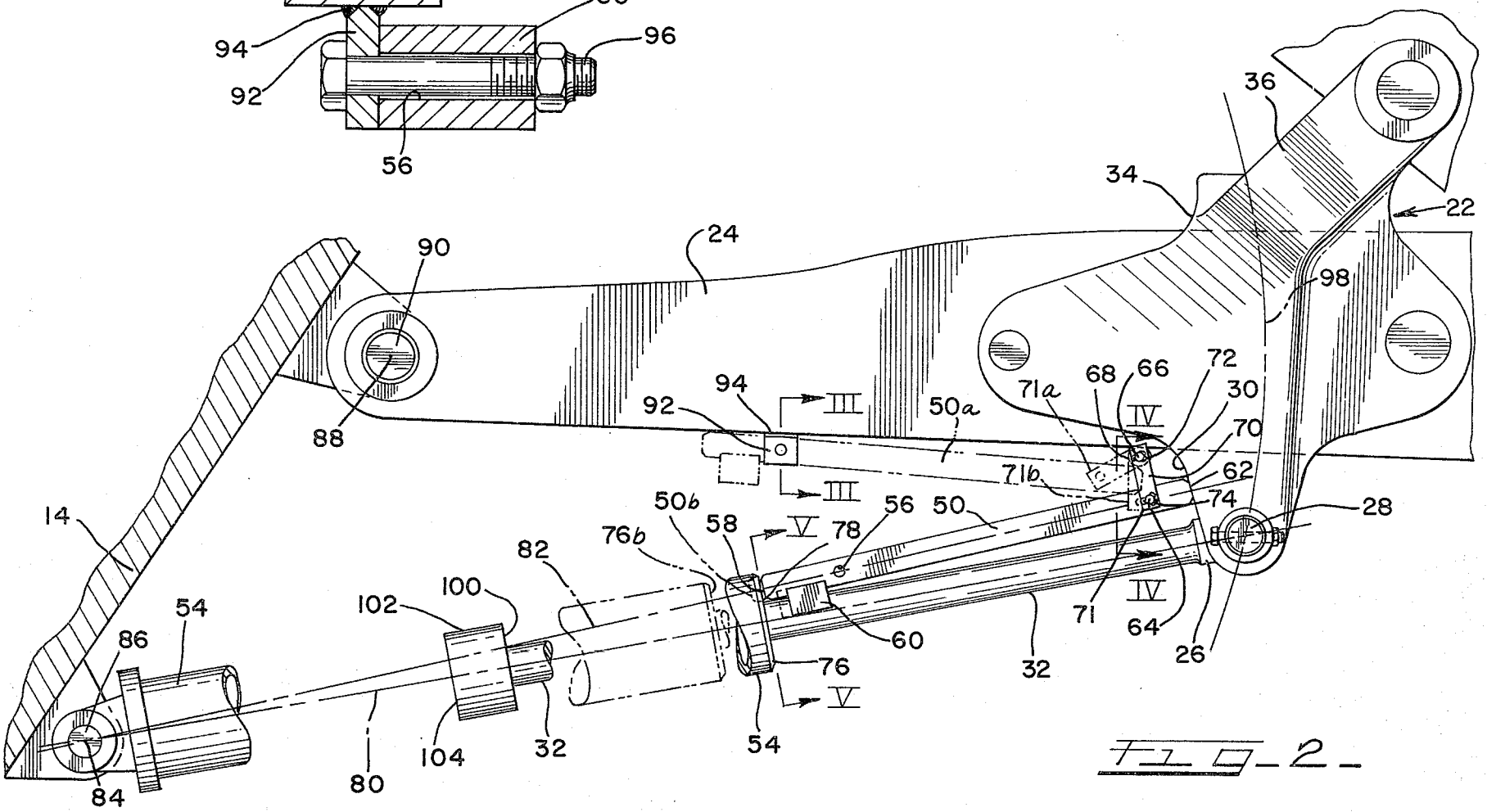
FIG. 2 is an enlarged side elevational view, like FIG. 1 but limited to the loader boom arm structure, and associated lift cylinder and safety bar.

BAR OPERATIVE — FIGS. 2 and 5

The lift cylinder 26 has a cap 76 on the end of the cylinder 54 containing the usual seals and rod guide, not shown, for the adjacent cylinder rod 32, with which the cap 76 cooperates to define a generally right angle notch 78. When operative with respect to the lift cylinder 26, the bar 50 is in its relatively closest position as shown in solid lines in FIGS. 2 and 5.

In such position, the safety bar 50 is restrained at the end by the swing connection thereof formed by the hanger link 71. The thus restrained end is laterally upwardly offset from the rod 32 and rod pivot 28 carried by the arm crook 30 of the lift arm 24, whereby the respective cylinder axis indicated at 80 and the bar axis indicated at 82 are caused to converge rearwardly at an angle in a vertical plane and the latching abutment base 58 of the bar is thereby caused to angle into seated engagement trapped in the notch 78. More specifically, the convergent axes 80 and 82 intersect precisely at the fixed swing center 84 for the cylinder 26 as established by a pivot 86 between the cylinder end of the lift cylinder 26 and the loader carrier frame schematically indicated at 14 (FIG. 2). Consequently, the piston rod 32 and cylinder 54 at their juncture are protected against rod-guide-and-seal bending load. In other words, the cylinder 54 is put under compression therethrough as a direct metal propping path between its cap 76 and fixed swing center 84, and thus negates any chance of a bending moment arising between the bar 50 and the piston rod 32.

In the loader carrier frame 14 above and forwardly of the cylinder swing center 84, the lift arm 24 has a fixed swing center 88 defined by a pivot 90 between the rear end of the lift arm 24 and the schematically shown carrier frame 14.

Figure 3:
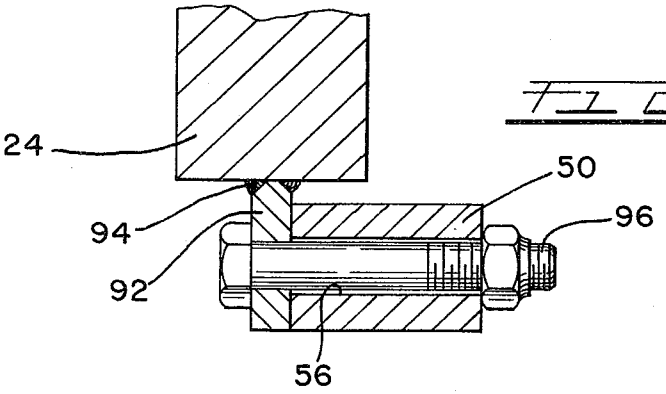
FIG. 3 is an elevational cross section view taken along the line III — III in FIG. 2, showing a releaseable connection at the free end of the safety bar.

BAR INOPERATIVE — FIGS. 2 and 3

When inoperative with respect to the lift arm 24, the bar 50 is in its relatively closest position as shown in broken lines 50*a* (FIG. 2) and in solid lines (FIG. 3).

Consistent with this proximity, the hanger link takes the rearwardly swung, nearly horizontal position as shown by the broken lines 71*a*. A bolt lug 92 is secured by welding 94 to the underside of the lift arm 24 in general longitudinal alignment with the bearing sleeve 68 so as to be contiguous with the inboard side of the safety bar 50. The bar's bolt aperture 56 is made to align with a registering aperture in the lug 92, and a bolt and nut fastener 96 is passed through and fastened so as to cooperate with the hanger link 71 in securely suspending the safety bar out of the way for its period of storage.

BAR TRANSITION — FIGS. 2, 3, and 5

The case occurs when the cylinder 26 is extended whereby the rod eye pivot 28 moves to a point higher along the fixed vertical arc 98 of swing of the lift arm than shown in FIG. 2, that the fastener 96 (FIG. 3) is unfastened to release the bar 50, in which case the bar relative to the broken line position 76*b* of the cylinder cap has the broken line position 50*b* and the hanger link has the broken line position 71*b* (FIG. 2). Cylinder pressure is therefore applied to a cylinder-lower face 100 of the piston 102 carried by the piston rod 32 so as to retract the rod to a slightly less extended position in which the latching abutment base 58 of the bar and the cap 76 of the cylinder engage endwise. Further limited retraction causes limited movement of the bar in its direction of elongation so as to adjust endwise forwardly into solid abutment between and connecting the notch 78 and the arm crook 30 just being engaged by the ram abutment base 62. The engaged surface of the arm crook, to prevent any lateral force component, is essentially tangent to the bar about the center 84, and the bar 50 is normal to the arm crook surface The hanger link will in the meantime have adjusted from its generally vertical depending position as shown by the broken lines 71*b* into the forwardly swung position as shown by the solid lines 71.

Also, the case occurs where the fastener 96 is unfastened and the bar 50 is released when the cylinder 26 is foreshortened, in which case the free end of the bar in the broken line position as shown by the broken line 50*c* in FIG. 5 will rest centered directly on top of the cylinder in its broken line position as shown by the broken lines 54*c*. Cylinder pressure would therefore be required on the cylinder-raise face 104 of the piston 102, causing extension so that the free end of the bar will ride off the end of the cap and the cap and bar will take the relative positions appearing by their respective broken line showings 76*b* and 50*b* in FIG. 2. Thereafter, cylinder pressure is applied on the cylinder-lower face 100 in the manner previously described to reverse the cylinder and bring both end bases 58 and 62 of the safety bar 50 into their operative position of abutment described.

The cylinder pivot connection 28 is offset downwardly from the lower face of the lift arm 24 and from the bearing sleeve 68 by a distance equal to the length of reach of the arm crook 30 which depends from the cast multi-arm structure 34. The hanger link 71 has an effective length enabling it, when the bar is in the operative position, to retain the restrained end of the bar offset below the bearing sleeve 68 by an appreciable fraction of the distance between the sleeve 68 and the rod 32, and offset above the rod 32 by an appreciable fraction of the distance between the sleeve 68 and rod 32. More specifically, in one physically constructed embodiment of the invention, the shackle lower leg 64 was approximately 4/7 of the distance from the axis of the upper leg of the shackle 66 to the nearest opposite point on the rod 32.

The installed attitude of the bar 50 is such that the axis 82 defined by its center line makes an angle of at least 2° to the cylinder axis 80 in a forwardly and upwardly diverging relation. In the physically constructed embodiment of the invention illustrated, such installed angle measured 2.9°. The corresponding acute angle made by the bar 50 to the cylinder cap 76 was 87.1°. So angling into the notch 78 shown in FIG. 2 prevents slip-out from the notch 78 and ensures that the bar when in its operative position illustrated in solid lines will not be dislodged if the tractor-loader is driven around with the lift arm 24 holding it positioned in the arm crook 30 as illustrated. Or, if the rod 32 is further extended by application of cylinder pressure upon the cylinder-raise face 104 of the piston, the weight of the bar 50 will retain it in place on the rod 52 due to gravity. Similarly, by gravity, the bar will automatically latch into place from its broken line position 50*c* in FIG. 5 into the solid line position there shown, after riding off the end of the cylinder in its position shown by the broken lines 54*c* as the cylinder is being extended.

The operator-operated control valves and connecting hydraulic lines to the hydraulic cylinders 26 and 42 and other cylinders of the crawler-loader 10 are conventional. They will not be described and, except for some portions of the hydraulic lines appearing in FIG. 1, the valves and lines will not be shown for sake of simplicity.

The fastener 96, FIG. 3, is permanently stored on the crawler-loader in the respect that, at the time the bar is released, the fastener 96 is reinstalled on the bolt lug 92 to ensure safe keeping at all times. And the hanger link 71 ensures permanent retention of the safety bar 50 on the crawler-loader when in the operative and inoperative positions, and when swinging therebetween through various transition positions described. The geometry of the bar 50 at its free, swing-guided relation along the axis 82 at a mutual right angle to the hanger link 71, and the geometry of the bar 50 in its relation of normalcy to the essentially tangent surface of the arm crook 30 engaged by the ram abutment base 62 of the bar, protect the hanger link 71 against assuming any prop compressive load and, moreover, insure against unwanted creation of any prop lateral load acting to an appreciable extent on the hanger link 71. In other words, the bearing sleeve 68 defining the bar swing axis is freed of all prop load, including horizontal, torsional, and vertical load, because the bar 50 takes its operative position always perpendicular both to the link 71 and the arm crook surface in compression.

Variations within the spirit and scope of the invention described are equally comprehended by the foregoing description.

What is claimed is:

1. In a generally longitudinally disposed linkage in a loader, the combination including:

a generally upright loader carrier frame;

boom structure and lift rod-and-cylinder structure projecting at the end forwardly from the frame;

said boom and cylinder structures at the projecting end being secured together by a pivotal connection therebetween at a point on the boom structure offset downwardly by an arm crook thereon and at a point on the end of the rod, and at the rear end being swingably connected to said frame in an upper portion and in a lower portion, respectively, to swing up and down substantially parallel to one another in a longitudinal vertical plane, the cylinder to said cylinder structure and the extended portion of the rod relative thereto forming an engageable notch at their external juncture; and a rigid, elongated prop between the boom and cylinder structures to hold the rod in an extended position relative to its cylinder, said prop at a free end thereof projecting rearwardly, and at a restrained end being swingably connected to the boom structure to swing from an inoperative upper position, to an operatve lower position with the restrained end retained by the swing connection projecting toward seated registry in the crook of the arm and the free end projecting toward seated registry in said notch.

2. The invention of claim 1 characterized by:

said prop being restrained in the operative position by the swing connection so that the restrained end is retained laterally upwardly offset from the rod and the pivot connection between the boom and cylinder structures, whereby the respective axes of the cylinder structure and prop are caused to converge rearwardly at an angle and said free end is thereby caused to angle into seated engagement trapped in said notch.

3. The invention of claim 2, further including:

tabs on the free end of the prop straddling the rod to guide the free end into, and to prevent lateral displacement of the prop free end out of, the notch.

4. The invention of claim 2 further characterized by:

said axes converging substantially at the point of the swing connection of the rear end of the cylinder structure on the lower portion of th loader frame, said prop swing connection affording limited movement of the prop in its direction of elongation so as to adjust endwise in solid abutment between and connecting the notch and the crook of the arm.

5. The invention of claim 4, additionally characterized by:

the endwise adjustment of the prop into solid abutment, and its engagement against the cylinder structure in a position aligned with the point of the resulting intersection of said convergent axes at said point of swing connection establishing a direct metal propping path through the cylinder, protecting to a large degree the prop swing connection against prop compressive load and the rod and cylinder at their juncture against rod-guide-and-seal bending load.

6. The invention of claim 2, wherein the prop swing connection is characterized by:

a pivot on the boom structure at a point opposite the rod so as to be above the pivot connection aforesaid between the boom and cylinder structures, and a depending hanger link pivoted at one end on said pivot and at the depending end to the restrained end of the prop, the hanger link having an effective length enabling it, when the prop is in the operative position, to retain the restrained end of the prop offset below the pivot by an appreciable fraction of the distance between the pivot and rod, and offset above the rod by an appreciable fraction of the distance between the pivot and rod.

7. The invention of claim 2, further characterized by:

the angle of convergence between the axes of the respective cylinder structure and prop being at least about 2°.

8. The invention of claim 2, the prop comprising a gravity-actuated latching bar.

* * * * *